United States Patent [19]

Wixon et al.

[11] 4,183,815

[45] Jan. 15, 1980

[54] LAUNDRY DETERGENT COMPOSITIONS

[75] Inventors: Harold E. Wixon, New Brunswick; Ronald S. Schreiber, Highland Park, both of N.J.

[73] Assignee: Colgate-Palmolive Company, New York, N.Y.

[21] Appl. No.: 905,622

[22] Filed: May 15, 1978

[51] Int. Cl.[2] ..... D06M 13/50

[52] U.S. Cl. ..... 252/8.8; 8/137; 252/8.6

[58] Field of Search ..... 252/8.8, 8.6, 135; 8/137; 423/118, 328

[56] References Cited

U.S. PATENT DOCUMENTS

| | | | |
|---|---|---|---|
| 3,748,093 | 7/1973 | Gangwisch et al. | 8/137 |
| 3,755,201 | 8/1973 | Trimmer et al. | 252/526 |
| 3,886,075 | 5/1975 | Bernardino | 252/8.8 |
| 3,936,537 | 2/1976 | Baskerville et al. | 252/8.8 |
| 3,966,629 | 6/1976 | Dumbrell | 8/137 |
| 4,075,280 | 2/1978 | Fitton et al. | 423/118 |

*Primary Examiner*—William E. Schulz

*Attorney, Agent, or Firm*—H. S. Sylvester; M. M. Grill; N. Blumenkopf

[57] ABSTRACT

Laundry detergent compositions containing halloysite, kyanite or mixtures of these with each other or with metakaolin or bentonite. Compositions preferably contain a quaternary ammonium fabric softener.

26 Claims, No Drawings

LAUNDRY DETERGENT COMPOSITIONS

This invention relates to detergent compositions, particularly those containing quaternary ammonium compounds.

Detergent compositions containing quaternary ammonium compounds, as fabric softeners or antistatic agents, are well known in the art. Detergent compositions containing bentonite clays of the high swelling type are also well known and have long been known to provide a softening effect on the fabrics being washed. The use of these ingredients in detergent compositions causes significant problems. Thus, Baskerville et al. U.S. Pat. No. 3,936,537 of Feb. 3, 1976, column 9 lines 1–26 discusses the well known quaternary ammonium compounds used as antistatic agents and says "However, addition of this product to the wash causes a marked decrease in sudsing and cleaning performance, while not providing any noticeable antistat or softening benefit to the fabrics. It is postulated that these effects are due to the large surface area: mass ratio of the antistat particles which results in an appreciable proportion of the anionic surfactants being used to not only neutralize the positive charge of the quaternary, but also absorb on the neutralized particle and convert it into an anionic particle. This reverses the force normally tending to attract the quaternary cation to the anionic fabric surface and as the particles are very small, they are not large enough to be trapped in the fabric fibers so that no deposition or benefit accrues."

"The use of a solid powdered form of the quaternary, while ensuring that the initial particle size on contact with water is larger, does not prevent the attainment of a small, ultimate particle size, although it is larger than that obtained when a liquid product is diluted. It is believed that this ultimate particle size is typical of that realized by quaternary materials that have been incorporated into granular products by addition to the detergent slurry prior to spray drying. Some antistatic benefit can be obtained if high levels of the quaternary, e.g., >10% by weight of the product, are used although cleaning and sudsing are sacrificed."

The recent patent literature describing the use of clays in detergent compositions having a fabric softening effect repeatedly stresses the necessity of using a clay having a high ion exchange capacity (see the previously cited Baskerville et al. patent). At the same time the use of such a clay in conjunction with the quaternary antistatic agent creates problems; thus Bernardino U.S. Pat. No. 3,886,075 states "It is a critical aspect of this invention to avoid affixing the quaternary compound to the surface of the clay by an ion exchange mechanism."

"The insolubility of the quaternary salts used herein is a critical aspect of this invention inasmuch as water-soluble quaternary salts become chemically affixed to the surface of the clay. When the quaternary antistatic agent is affixed to the surface of the clay it does not provide the desired anti-static effects on fabrics."

In that Bernardino patent an "amino compatibilizing agent" is employed to

"mitigate the interactive effects of quaternary ammonium anti-static agents and conventional detergent laundering compositions."

"The ion-exchange problem is avoided by employing a melt of the quaternary compound and at least a portion of the amino compatibilizing agent to spray onto the granules."

One aspect of this invention relates to the inclusion of relatively large amounts of metakaolin in a laundry detergent composition. It is found that the addition of the metakaolin gives some fabric-softening effect and good detergency. It is also found that one may include quaternary antistatic agents in the detergent compositions containing the metakaolin with good retention of detergency while attaining an excellent fabric-softening effect.

Meta-kaolin is generally produced by heating to drive off water from the kaolinite lattice and produce a material which is substantially amorphous, by X-ray examination, but which retains some of the structural order of the kaolinite. Discussions of kaolin and metakaolin are found in U.S. Pat. No. 4,075,280 columns 3 and 4 and Grimshaw "The Chemistry and Physics of Clays and Allied Ceramic Materials" (4th ed., Wiley-Interscience), pages 723–727.

Particularly good results are obtained with certain types of metakaolins, discussed below, especially in formulations containing a substantially water-insoluble solid quaternary antistatic agent of the type described in U.S. Pat. No. 3,886,075.

Another aspect of this invention relates to the inclusion of large amounts of a mixture of smectite clay and metakaolin in a laundry detergent composition. It is found that the mixture of smectite clay and metakaolin can give as good softening as the smectite clay alone, with good detergency. It is also found that one may include quaternary antistatic agents in the detergent compositions containing the smectite-metakaolin mixture and attain an excellent fabric-softening effect with good detergency.

The compositions containing the metakaolin appear to yield washed fabrics of superior whiteness rating. Thus, comparisons involving smectite clay of U.S. Pat. No. 3,886,075 (e.g. Thixojel #1) vs. metakaolin (e.g. Satintone #2, identified below) indicate that the whiteness values (as measured on the "b" scale of a Gardner Color Difference Meter) are better for the metakaolin-containing formulations. The reasons for this are not clearly understood. Both the Thixojel #1 and Satintone #2 are light in color and it may be that the smectite clay deposits on the fibers to such a degree that it decreases the whiteness, while the incorporation of metakaolin does not significantly affect the whiteness adversely (or it even improves it) as compared to a control composition without smectite clay or metakaolin. In one series of tests, the control composition gave a b value of −5.8; the control plus 5% quat ("TA−100", identified below ) gave a yellower value, −5.3; while the control plus 5% quat ("TA−100") and 20% Satintone #2 gave a whiter value, −6.3; a difference of 0.5 b unit is readily noticeable visually.

In still another aspect of this invention it is found that certain other aluminosilicates known as halloysite and kyanite may be used in place of the metakaolin, or in admixture therewith, to attain similar softness, especially when used with quats.

One may employ a mixture of one or more of these aluminosilicates (metakaolin, halloysite, kyanite) as such, or in admixture with smectite clay (preferably the well known swelling type of bentonite). The total proportion of these aluminosilicates (metakaolin, halloysite, kyanite) is above about 5% of the total detergent composition, preferably at least about 10% (e.g. 15, 20, 25, or 30%). In such mixtures the proportion of each individual component (metakaolin, halloysite or kyanite) may be, for example, 20, 30 or 40% or more of the total clay material; the weight ratio of the individual component to surface active detergent may be, for instance, about 0.3:1 or higher.

Certain aspects of the invention are illustrated in the following examples. In this application all proportions are by weight unless otherwise indicated.

EXAMPLE 1

1A. Soiled fabrics are washed in a washing machine in New Brunswick, N.J. tap water (having a hardness of about 100 ppm, expressed in $CaCO_3$) containing 0.15% of an alkaline laundry detergent mixture ("Detergent I", comprising anionic surfactant, builder salt and other conventional ingredients as specified below). 1B. Example 1A is repeated except that the wash water also contains 0.03% of metakaolin.

Soil removal is found to be slightly, but significantly, better for 1B as compared to 1A.

The metakaolin used in this Example is a product sold as X-1929 by Engelhard Minerals and Chemical Co. having the properties tabulated below.

EXAMPLE 2

100 parts of Detergent I is dry-blended with 19.2 parts of metakaolin (as in Example 1 ) and 5 parts of a quaternary ammonium antistatic agent known as "Arosurf TA−100" (this agent sold by Ashland Chemical Co., is a powder having an active ingredient content of at least 93% and containing distearyl dimethylammoniumchloride; at least 95% of its long chain alkyl content is C18 and its melting point is about 80–95° C.)

The resulting blend is employed in the washing test described in Example 1A above, using water containing 0.15% of the same alkaline laundry detergent as used in Example 1A, 0.03% of the metakaolin and 0.0078% of the antistatic agent.

Tests show excellent softening properties and only moderate loss of detergency as compared to a control using the same alkaline laundry detergent mixture without the metakaolin and antistatic agent.

EXAMPLE 3

3A(1) Example 1A(1) is repeated.

3A(2) Example 3A(1) is repeated except that the wash water also contains a 90/10 blend of the metakaolin of Example 1 with "Varisoft 137", which is an antistatic waxy solid containing at least 90% of di(hydrogenated tallow) dimethyl ammonium methyl sulfate, sold by Ashland Chemical Co. The metakaolin-antistatic blend is made by mulling the ingredients together (by mixing them at room temperature with a mortar and pestle) and it is used in amount of 25 grams per 100 grams of Detergent I.

Soil removal is found to be substantially the same for 3A(2 ) as for 3A(1). In tests for fabric-softening and antistatic effects and mixture used in 3A(2) (containing metakaolin and antistatic) is found to be far superior to that used in 3A(1).

3B(1) Example 3A(1) is repeated using a different alkaline laundry detergent composition, specifically a commercial product sold as "Tide", believed to have the composition tabulated below as Detergent II.

3B(2) Example 3B(1) is repeated except that the wash water also contains an 80/20 blend (made by mulling together, as described in 3A(2)) of the metakaolin used in Example 1 and Variquat A200, a liquid product sold by Ashland comprising a short chain quaternary ammonium compound specifically allyl trimethylammonium chloride. The amount of this metakaolin/quat blend is 25 grams per 100 grams of the alkaline detergent mixture.

3B(3) Example 3B(2) is repeated, but using another metakaolin, namely Glomax Metakaolin SP. No. 2474 of Georgia Kaolin Co. having the characteristics tabulated below.

3C(1) Example 3A(1) is repeated except that the wash water also contains 21 grams of another metakaolin (Satintone No. 2whose characteristics are tabulated below) per 100 grams of Detergent I. Soil removal is at least as good as in 3A(1).

3D(1) Example 1A(1) is repeated except that the alkaline laundry detergent mixture is Detergent III, tabulated below.

3D(2) Example 3D(1) is repeated except that the wash water also contains 25 grams (per 100 grams of the alkaline laundry detergent mixture) of a 20/5 mulled blend of the metakaolin used in Example I and Variquat A200 made by mulling these two ingredients together with a mortar and pestle at room temperature. Soil removal is found to be substantially the same for 3D(2) as for 3D(1). In tests for fabric-softening effects, 3D(2) shows significant softening as compared to 3D(1).

The short chain quaternary ammonium compound "Variquat A200" is a liquid which disperses well in water. When the longer chain quaternary compound "Varisoft 137" is added to water it does not disperse but floats on top.

A mulled mixture of either the liquid or waxy quat and metakaolin disperses well in water, but the dispersed material settles out considerably faster than a dispersion of metakaolin alone; e.g., the dispersion of metakaolin alone may still be cloudy after 15 minutes of standing while the mulled mixture may settle out after about 2 minutes.

When metakaolin alone is dispersed in water and the waxy long chain quat is mixed therein a good dispersion is formed; it settles in about the same time as the dispersion of a mulled mixture of liquid short chain quat and metakaolin.

When metakaolin alone is dispersed in water and the liquid short chain quat is added thereto a good dispersion is formed which takes longer to settle than a dispersion of a mulled mixture of the same ingredients.

Mulling the metakaolin with the quats makes the metakaolin feel gritty (presumably due to agglomeration of its tiny particles.)

EXAMPLE 4

The following laundry detergent formulations are prepared by spray-drying an aqueous mixture of all the ingredients except the quaternary ammonium compound and then dry blending the latter (in powder form) with the resulting hollow spray-dried granules.

| | A | B | C | D | E |
|---|---|---|---|---|---|
| Sodium linear tridecylbenzenesulfonate | 15 | 14.3 | 15 | 14 | 18 |
| Satintone #2 | 20 | 19 | 20 | 18 | 20 |
| Arosurf TA-100 | 5 | 5 | 5 | 5 | 5 |

-continued

| | A | B | C | D | E |
|---|---|---|---|---|---|
| Pentasodium Tripolyphosphate ("TPP") | 33 | 31 | 24 | 24 | 0 |
| Sodium silicate (solids based ($Na_2O$:$SiO_2$ratio 1:2.4) | 7 | 7 | 7 | 7 | 15 |
| Soda Ash | — | 4.8 | 5 | 5 | 20 |
| Borax | — | — | — | — | 3 |
| Optical brighteners, bluing, other colors, and perfume | ←minor→ | | | | |
| Sodium sulfate | 9.3 | 8.2 | 12 | 15 | 13 |
| Water | 10 | 10 | 10 | 10 | 3 |

In preparing the mixture for spray driving, water is added to a crutcher, followed (in the order given below) by the sodium alkylbenzenesulfonate, sodium silicate, minor ingredients, Satintone #2, sodium sulfate, TPP and (when used) soda ash. The mixture in the crutcher is heated to about 140° F. before addition of TPP, and the solids content of the crutched mixture before spraying is about 60% for B and about 57% for A.

Formulations containing TPP, such as 24 parts TPP, or no TPP may also be prepared, as indicated in C, D and E above (formula E also contains 1% sodium carboxymethylcellulose).

The optical brighteners and bluing may be dyes or pigments. In the foregoing formulas A, B, C and the brighteners and colors comprise (see U.S. Pat. Nos. 3,748,093, 3,755,201): (a) brighteners: 0.4% Stilbene #4 and 0.08% Tinopal 5BM; (b) bluing: 0.0019% Direct Brilliant Sky Blue 6B, 0.0006% Solophenyl Violet 4BL, 0.0006% Cibacete Brilliant Blue RBL and 0.0002% Cibacete Violet B, 0.03% Polar Brilliant Blue RAW and 0.003% Calcocid Blue 2G. In home laundry work it is sometimes recommended that powdered detergent composition be applied, as an aqueous paste, directly to the fabric for better removal of certain stains; for compositions (containing quaternary ammonium compounds) to be used in that way it is preferable to use pigment-type bluing such as ultramarine blue; for instance the composition may contain 0.1% ultramarine blue, 0.01% Acid Blue No. 9 (a dye to tint the powder), 0.4% Stilbene Brightener No. 4 and 0.08% Tinopal 5BM Brightener.

Spray drying may be carried out, in conventional manner, by pumping the hot mixture from the crutcher to a spray tower where the mixture passes through a spray nozzle into a hot evaporative atmosphere.

EXAMPLE 5

Kaolin Clay (Acme SP No. 70716 Anglo-American Clay Corp.; "clay sample II" in the Tabulation of Metakaolins below) is fired at different temperatures and for different times and the products are tested for fabric-softening effects as follows:

The wash water is New Brunswick, N.J. tap water containing 0.15% of Detergent III together with (per 100 parts of Detergent III) 20 parts of the metakaolin and 5 parts of Arosurf TA-100, added to the wash water without pre-mulling. The materials fired at 750° C. for 1 hour and 3 hours or at 950° C. for ½ hour give significantly better softening (like that of Satintone No. 2) than the materials fired for ½ hour at 750° or at 1 hour at 950° C. or at ½, 1 or 3 hours at 500° C. or the Glomax metakaolin of Example IIIB(3) or Satintone No. 1.

EXAMPLE 6

In this Example, spray dried granules (without post-added quat) of formula B in Example 4 are used for washing fabrics in conjunction with the following quats which are added to the wash water (but not pre-mixed with the spray-dried granules) in the amounts indicated (per100 g of spray-dried granules):

(A). Arosurf TA-100, 5g;

(B). Varisoft 190-100P (distearyl dimethyl ammonium sulfate, Ashland), 5g;

(C). Varisoft 475 (a liquid, 77–79% solids concentration, methyl (1) tallow amido ethyl (2) tallow imidazoliniummethyl sulfate Ashland), 4.5g of active ingredient;

(D). Adogen 442 (a paste, 90% solids, of di hydrogenated-tallow dimethyl ammonium chloride), 4.5g of active ingredient.

Best results in this series are obtained in 6A and 6B. The quats in liquid form (C and D) do not behave as well. The washed fabric of 6C has a softness rating about the same as that of the fabric washed with the spray dried material but without the quat, and its -b rating is poorer. These effects may be due, at least in part, to inadequate dispersion of the liquid quat under the particular washing conditions.

EXAMPLE 7

A. Fabrics are washed in wash water containing 0.15% of an alkaline laundry detergent (Detergent III, tabulated below) at 120° F. The water is New Brunswick, N.J. tap water (having a hardness of about 100 ppm expressed as $CaCO_3$). B. Example 7A is repeated except that the wash water also contains 20 parts of smectite clay (Thixojel No. 1) per 100 parts of laundry detergent.

C. Example 7A is repeated except that the wash water also contains 20 parts of metakaolin (Satintone No. 2) per 100 parts of laundry detergent.

D. Example 7 A is repeated except that the wash water also contains 10 parts of the Thixojel No. 1 and 10 parts of Satintone No. 2 per 100 parts of laundry detergent.

E. Example 7A is repeated except that the wash water also contains 5 parts of the Thixojel No. 1 and 15 parts of Satintone No. 2 per 100 parts of laundry detergent.

Example 7D gives the softest washed fabrics, equal to or better than B; 7E is noticeably better than 6C.

F. Inclusion of 5 parts of Arosurf TA-100 in the composition of Example 7D gives outstanding softness.

EXAMPLE 8

A. Fabrics are washed in wash water containing 0.15% laundry detergent (Detergent III, tabulated below) at 120° F. The water is New Brunswick, N.J. tap water (having a hardness of about 100 ppm expressed as $CaC0_3$).

B. Example 8A is repeated except that the wash water also contains 20 parts of halloysite clay per 100 parts of laundry detergent. This clay, supplied by Harris Mining Company of Spruce Pine, North Carolina contains (according to the supplier) about 50–75% of the mineral halloysite. Details, supplied by the Harris Mining Company. Before using it in these Examples the crude halloysite is bleached by mixing 212 g thereof with 600 g water and, while stirring, slowly adding 20 g sodium hydrosulfite (dithionite), stirring 30 more minutes, filtering, thoroughly washing with water and drying in an oven (at below 110° C).

C. Example 8A is repeated except that the wash water also contains 20 parts of halloysite and 5 parts of Arosurf TA-100.

D. Example 8C. is repeated except that kyanite is used in place of halloysite. The kyanite is raw kyanite ground and/or sieved to pass a 325 mesh (U.S. Standard) sieve. According to the supplier, it shows a loss on ignition of 0.21%, analyzes about 60% alumina, 38.65% silica and small amounts of iron oxide, titania, lime, magnesia and alkalis; has a specific gravity of 3.5 to 3.7, its particle shape is "bladed (elongated)" and it is mined at Dillwyn (Willis Mountain) or Cullen (Baker Mountain), Virginia, by the Kyanite Mining Corporation.

E. Example 8C is repeated except that Satintone No. 2 is used in place of halloysite.

The washed fabrics of 8B are markedly softer than those of 8A, while the fabrics of 8C and D are much softer than either of the other two and about as soft as those of Example 8E.

TABULATION OF LAUNDRY DETERGENTS

| | I | II (approx) | III |
|---|---|---|---|
| sodium linear alkylbenzene-sulfonate (anionic detergent) | 9.9 | 7 | 15 |
| mixed fatty alcohol sulfates (anionic detergent) | | 11 | |
| polyethoxylated fatty alcohols (nonionic surfactant) | 1 | 1½ | 0.5 |
| soap | 0.7 | | |
| sodium carbonate | | 1½ | 5 |
| sodium silicate | 7 | 11 | 7 |
| Borax | | | 1 |
| Total phosphates (largely sodium tripolyphosphate) | 31.5 | 24 | 33 |
| sodium sulfate | 37.2 | 35 | 26.6 |
| water | 11 | 8 | 11 |
| brighteners and other minor ingredients (such as sodium carboxymethyl cellulose) | 2 | 2 | 2 |

-continued

| | Loss on Ignition at 1000° C. for 1 hr | Loss on Ignition to constant weight | Loss on Ignition at 850° C. for 35 min. | Specific Surface ($m^2/g$) Infra-red Peak $cm^{-1}$ | Specific Surface ($m^2/g$) BET | Specific Surface ($m^2/g$) methylene Blue Index Method B | methylene Blue Index (meq./100g. Method A |
|---|---|---|---|---|---|---|---|
| Satintone #1 | 0.8, 0.6 | | 1.1 | 470,471 | 9 | 6.3 | 16 |
| Satintone #2 | 0.8, 0.6 | | 0.8 | 460,461,469 | 11 | 10.2 | 13 |
| Glomax 2474 | 1.0, 0.7 | | 1.0 | 470 | 7.8 | 4.7 | 9.5 |
| SP33 | 0.8, 0.6 | | | 462 | 14.3 | 9.8 | 13 |
| X1929 | 1.0, 0.5 | | | 461 | | 7.2 | 18 |
| Clay sample I | | | | | | 23.1 | |
| Unfired | | | | | | | |
| fired at: | | | | | | | |
| 650° C. | | | | | | | |
| ½ hr | 3.7 | | | | | 9.0 | |
| 1 hr | 1.2 | | | | | 10.2 | |
| 750° C. | | | | | | | |
| ½ hr | 1.4 | | | 465 | | 13.7 | |
| 1 hr | 0.5 | | | 465 | | 13.3 | |
| 1½ hr | 0.6 | | | | | 11.3 | |
| 3½ hr | 0.5 | | | 459 | | 12.1 | |
| 850° C. | | | | | | | |
| ¼ hr | 1.8 | | | | | | |
| ½ hr | 0.4 | | | | | | |
| Clay Sample II | | | | | | | |
| fired at: | | | | | | | |
| 550° C. | | | | | | | |
| ½ hr | 10 | | | | | | |
| 1 hr | 2.3 | | | 461 | | | |
| 3 hrs | 1.9 | | | 462 | | | |
| 750° C. | | | | | | | |
| ½ hr | | 0.8 | | 460 | | | |
| 1 hr | | 0.7 | | 463 | | | |
| 3 hrs | | 0.6 | | 463 | | | |
| 950° C. | | | | | | | |
| ½ hr | 0.3 | | | 468 | | | |
| 1 hr | 0.2 | | | 471 | | | |
| 3 hrs | 0.2 | | | 471 | | | |

The "fired" samples listed above are made by heating a stationary bed of a kaolin clay in a constant temperature furnace; it will be understood that heat transfer in such a bed is not as efficient as in a rotary kiln.

On firing to form the metakaolin the clay may darken (see the G.E. Brightness Values for Satintone No. 2 ) and then become lighter (see the corresponding values for other Satintones); the preferred materials are those that have not been fired to the color-lighten stage.

The methylene blue index (B) is determined by dispersing, by stirring, 2 grams of the material to be tested in 300 ml of deionized water, adjusting the pH to between 3 and 4 (by adding aqueous 1.5N HCl as required) and then, while stirring continues, adding aqueous 0.01N methylene blue chloride solution dropwise from a burette. One minute after each 1 ml of the methylene blue chloride solution is added a sample (a few drops) of the stirred slurry is removed with a pipette and placed, as a dot, on hardened filter paper (Whatman #42, ashless). At the beginning of this titration, the deposit of slurry on the filter paper appears as a compact dyed spot of clay, surrounded by excess uncolored water drawn off by the cellulose of the paper. When the endpoint is reached, methylene blue moves away from the clay spot and is absorbed by the cellulose, forming a blue halo around the darker clay spot and as a light blue coating on the reverse side of the paper under the clay.

As the endpoint is approached the samples of slurry are taken 2 minutes after addition of each ml of methylene blue solution to insure that full interaction between the slurry and the methylene blue has occurred. The data is reported as milliequivalents of methylene blue cation absorbed per 100g of clay, and multiply by 7.826 to give specific surface.

The methylene blue index (A) is determined by the following method: Prepare a stock aqueous solution of methylene blue of about 0.002M concentration; analyze (by absorbance at 665 nm) to determine its true concentration. Add 15 ml of the stock solution of 2 ml of a 1% slurry of the clay material in deionized water and adjust the temperature to about 70° F; stir 15 minutes; then pour off 13 ml of the mixture into a centrifuge tube and centrifuge at 1000 rpm for 10 minutes; then dilute 5 ml of the resulting supernatant liquid with 95 ml of deionized water and measure the absorbance (at 665 nm) of the diluted mixture to determine the amount of methylene blue retained in the solution. See article on "Methylene Blue Absorption..." by Hang and Brindley in Clays and Clay Minerals 1970, Vol. 18, pp. 203–212, Pergamon Press, which describes the same type of method. The method A described above gives a very rough value of the approximate degree of absorption.

Metakaolins which give the best fabric-softening effects in the practice of this invention also appear to behave best in the reaction with sodium hydroxide to form zeolite 4A as described in U.S. Pat. No. 3,114,603 which refers to such materials as "reactive kaolin" and also describes undesirable side effects, in zeolite 4A formation, of the less preferred types of metakaolins.

Pre-blends of quat and metakaolin or other aluminosilicate may be packaged, as such, without detergent and/or builder for use as additives to be employed by the consumer during home laundering. Thus when adding a conventional built detergent composition to the washing machine the consumer may, if fabric softening is desired, also add such a pre-blend to the washing machine before or during the wash cycle. The pre-blend preferably contains a powdered quat which is solid at room temperature. The pre-blend may be simply a dry mix of powders of the aluminosilicate (e.g. metakaolin) and quat or it may be formed into pellets or agglomerates, as by applying the aluminosilicate to a carrier material (e.g. as in U.S. Pat. No. 3,966,629) and spraying the granules with molten quat. Additional components may be present in the blend, e.g. particles of sodium sulfate or hydrated zeolite 4A, dispersing agents (such as a small amount, e.g. ½ or 1%, of anionic surfactant, which may be the same as that in the detergent composition), dry oxygen bleach (such as sodium perborate), enzymes to aid stain removal (e.g. proteolytic enzymes), brightener, etc.

In the practice of the invention the quaternary ammonium compound is preferably of the type described in U.S. Pat. No. 3,959,155 or 3,886,975 whose entire disclosures of quaternary ammonium compounds are incorporated herein by references or it may be a shorter chain quaternary ammonium compound. One may use the quaternary ammonium compounds (including imidazolinium compounds) which are set forth in U.S. Pat. No. 3,997,453. The quaternary ammonium compound may be used in the form of a mixture thereof with an electrically conductive salt uniformly dispersed therein, as described in U.S. Pat. No. 3,959,155, whose entire disclosure of such mixtures is incorporated hereby by reference. The proportion of quaternary ammonium compound is preferably such as to be effective for softening and/or reducing static buildup on laundered textiles, suitable proportions with respect to the other components and with respect to the washing liquor being disclosed in said U.S. Pat. Nos. 3,959,155 and 3,886,075.

The types and amounts of detergent or surfactant and builder salt or other adjunct materials may be those conventionally employed in the art and may be as disclosed in said U.S. Pat. Nos. 3,959,155 and 3,886,975 (whose disclosures thereof are incorporated herein by reference). Other suitable adjunct materials are cation exchangers capable of taking up calcium ions of hard water, such as cation exchange resins or insoluble metallo-silicates (e.g. zeolite 4A or 3A, zeolite X or Y in alkali metal, preferably sodium, form) as described for instance in U.S. Pat. No. 4,072,621.

Preferably the proportions are such that, for a conventional washing of 8 pounds (3500g) of clothes in 17 gallons (65,000g) of water, the mixture provides about 5 to 35 (more preferably about 8 to 25 ) gram of anionic surfactant, about 10 to 50 (more preferably about 15–35) grams of alkaline builder salt (preferably comprising a polyphosphate as such or, for instance, mixed with calcium-receptive zeolite such as zeolite 4A), about 2 to 12 (more preferably about 3to 10) grams of quat and about 5 to 50 (more preferably about 10 to 30) grams of the clay material such as metakaolin. Simple calculation will convert these weights into concentrations (by wt.) based on the wash water. When the product is granular and has an apparent specific gravity of about 0.33 cup weight, 80 g/cup) and is to be used in amount of about 1¼ cups (i.e. 100g) the weights given above in grams correspond to the percentages in the composition. A particularly preferred product contains about 10 to 20% anionic surfactant, about 20–35% TPP, (or less TPP, e.g. 12%, if the zeolite is present say in proportion of about 20%), about 12–20% of the clay material such as metakaolin, and about 3–6% of the quat. The pH imparted to the wash water by the composition is generally in the range of about 9 to 11 such as about 9.5 to 10.5. The weight ratio of anionic surfactant to quat is preferably in the range of about 2:1 to 5:1 and the ratio of clay material to quat is preferably in the range of about 3:1 to 7:1. Preferably the amount of clay material is at least about 0.8 part (more preferably in excess of 1 part, such as 1.2, 1.5 or even 2 parts or more ) per part of anionic surfactant.

It is understood that the foregoing detailed description is given merely by way of illustration and that variations may be made therein without departing from the spirit of the invention.

We claim:

1. A detergent composition comprising a surface active detergent and kyanite.

2. A detergent composition as in claim 1, in which the ratio of kyanite to surface active detergent is at least about 0.3:1.

3. A detergent composition as in claim 1 also containing a builder salt, said surface active detergent comprising an anionic detergent.

4. A detergent composition as in claim 1 containing a quaternary ammonium fabric softening agent.

5. A laundry detergent composition as in claim 4 in which the proportions are within the following ranges: about 10 to 20% anionic surfactant, about 20 to 35% builder salt, about 3 to 6% quaternary ammonium softening agent and about 12 to 20% clay material comprising kyanite.

6. A fabric softening mixture comprising kyanite and a quaternary ammonium fabric softening or antistatic agent.

7. A detergent composition comprising a surface active detergent and halloysite.

8. A detergent composition as in claim 7 also containing a builder salt, said surface active detergent comprising an anionic detergent.

9. A detergent composition as in claim 7 containing a quaternary ammonium fabric softening agent.

10. A laundry detergent composition as in claim 4 in which the proportions are within the following ranges: about 10to 20% anionic surfactant, about 20 to 35% builder salt, about 3 to 6% quaternary ammonium softening agent and about 12 to 20% clay material comprising halloysite.

11. A fabric softening mixture comprising halloysite and a quaternary ammonium fabric softening or antistatic agent.

12. A composition as in claim 2 also comprising metakaolin.

13. A composition as in claim 12 in which the ratio of metakaolin to surface active detergent is at least about 0.3:1.

14. A composition as in claim 13 containing a quaternary ammonium fabric softening agent.

15. A composition as in claim 7 also comprising metakaolin.

16. A composition as in claim 14 in which the ratio of metakaolin to surface active detergent is at least about 0.3:1.

17. A composition as in claim 16 containing a quaternary ammonium fabric softening agent.

18. A detergent composition comprising a surface active detergent and a mixture of smectite clay and metakaolin.

19. A composition as in claim 18 in which the ratio of metakaolin to surface active detergent is at least about 0.3:1.

20. A composition as in claim 19 containing a quaternary ammonium fabric softening agent.

21. A detergent composition comprising a surface active detergent and kyanite and halloysite.

22. A composition as in claim 5 comprising granules of a spray dried blend of said surfactant, a builder salt and said clay material said granules being mixed with post-added quaternary ammonium softening agent.

23. A composition as in claim 22 in which said quaternary ammonium compound comprises distearyl dimethyl ammonium chloride.

24. A composition as in claim 10 comprising granules of a spray dried blend of said surfactant, a builder salt and said clay material said granules being mixed with post added quaternary ammonium softening agent.

25. A composition as in claim 24 in which said quaternary ammonium compound comprises distearyl dimethyl ammonium chloride.

26. A composition as in claim 2 in which said surface active detergent is a non-soap synthetic detergent compound selected from the group consisting of anionic synthetic detergents, nonionic synthetic detergents, ampholytic synthetic detergents, zwitterionic synthetic detergents and mixtures thereof, and said composition contains an organic or inorganic detergent builder salt.

* * * * *